US006166707A

United States Patent [19]

Painter et al.

[11] Patent Number: 6,166,707

[45] **Date of Patent: *Dec. 26, 2000**

[54] ANTENNA SHROUD FOR A PORTABLE COMMUNICATIONS DEVICE

[75] Inventors: Paige Marie Painter, Bartlett; Martin E. Holmes, Hoffman Estates, both of Ill.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,830

[22] Filed: Sep. 23, 1997

Related U.S. Application Data

[63] Continuation-in-part of application No. 08/627,718, Apr. 1, 1996, abandoned.

[51] Int. Cl.[7] ..... H01Q 1/42

[52] U.S. Cl. ..... 343/872; 343/702

[58] Field of Search ..... 343/700 MS, 715, 343/702, 873, 895, 900, 872; H01Q 1/24, 1/42

[56] References Cited

U.S. PATENT DOCUMENTS

| | | | |
|---|---|---|---|
| 4,435,713 | 3/1984 | Gasparaitis et al. | 343/702 |
| 4,611,213 | 9/1986 | Johnson et al. | 343/702 |
| 4,725,845 | 2/1988 | Phillips | 343/702 |
| 4,760,401 | 7/1988 | Imazeki | 343/702 |
| 4,868,576 | 9/1989 | Johnson, Jr. | 343/702 |
| 5,245,350 | 9/1993 | Sroka | 343/702 |
| 5,262,792 | 11/1993 | Egashira | 343/702 |
| 5,300,940 | 4/1994 | Simmons | 343/749 |
| 5,440,315 | 8/1995 | Wright et al. | 343/702 |
| 5,507,012 | 4/1996 | Luxon et al. | 343/702 |
| 5,534,878 | 7/1996 | Johnson | 343/702 |
| 5,650,790 | 7/1997 | Fukuchi et al. | 343/702 |
| 5,914,689 | 6/1999 | Cockson | 343/702 |

*Primary Examiner*—Tho Phan
*Attorney, Agent, or Firm*—Frank M. Scutch, III

[57] ABSTRACT

An antenna shroud (100) used for covering an antenna element includes a hollow non-conductive sheath (101) attached to a base (103). The base (103) is used for holding the sheath (101) into a fixed positioned while the antenna shroud (100) is positioned within an aperture (114) located within a radio housing. The antenna shroud (100) is used to seal the antenna opening in the radio housing and for protecting the antenna element from damage. Additionally, the antenna shroud (100) also is used to protect a user from coming into direct contact with radio frequency energy radiated by the antenna element.

2 Claims, 4 Drawing Sheets

ANTENNA SHROUD FOR A PORTABLE COMMUNICATIONS DEVICE

CROSS REFERENCE TO RELATED APPLICATIONS

This application is a continuation-in-pat U.S. patent application Ser. No. 08/627,718, filed Apr. 1, 1996 now abandon, by Painter et al., entitled "ANTENNA SHROUD FOR A PORTABLE COMMUNICATIONS DEVICE," and assigned to Motorola, Inc.

TECHNICAL FIELD

This invention relates in general to antennas and more particularly to antenna housings.

BACKGROUND

Conventional portable antennas used with two-way portable radios have a removable antenna which can either screw into an insert-molded, machined metal nut or can attach to an electrical connector such as a coaxial connector. Occasionally this nut or connector is closed at the bottom and there is an environmental seal between the nut or connector and the surrounding housing plastic.

In cases where the nut is not closed, the antenna jacket "skirt" gets compressed axially against the top of the housing when the antenna is tightened. The electrical connector usually has an axially compressed O-ring and nut on the interior of the radio. In both cases, this component is relatively expensive because it must have a die cast or machine screw stud or electrical connector to attach to the radio, and an antenna element with an over-molded or heat-shrink jacket.

Currently, one additional antenna option is an antenna which merely utilizes a simple coax monopole antenna element without any protective cover. This element is permanently attached to the board and has no housing or covering to protect the element or user. In most applications, the element is relatively short as compared with a standard full size whip antenna of the same frequency.

Since this type of antenna has a short length, it need not be removable. Thus, any housing or covering used to protect the antenna can be a more permanent structure. One problem associated with covering this type of antenna is the manner and/or type of cover used. Accordingly, the need exists to provide an easily attachable antenna housing which can be used on a permanent basis to seal the antenna opening in the radio housing. The antenna housing should provide damage protection for the monopole antenna as well as protection to a user from coming directly into contact with radio frequency (RF) energy.

DETAILED DESCRIPTION OF THE PREFERRED EMBODIMENT

Figure 1:
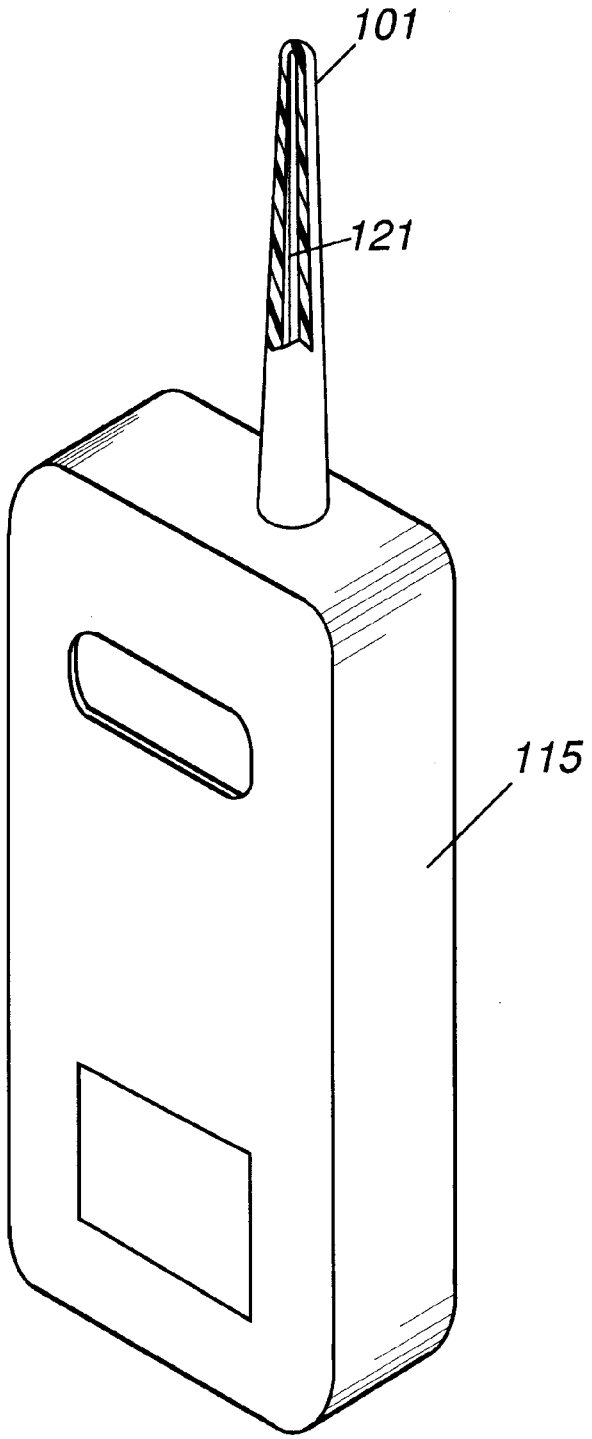
FIG. 1 is an isometric view of a typical radio using the antenna shroud in accordance with the preferred embodiment of the invention.
Figure 2:
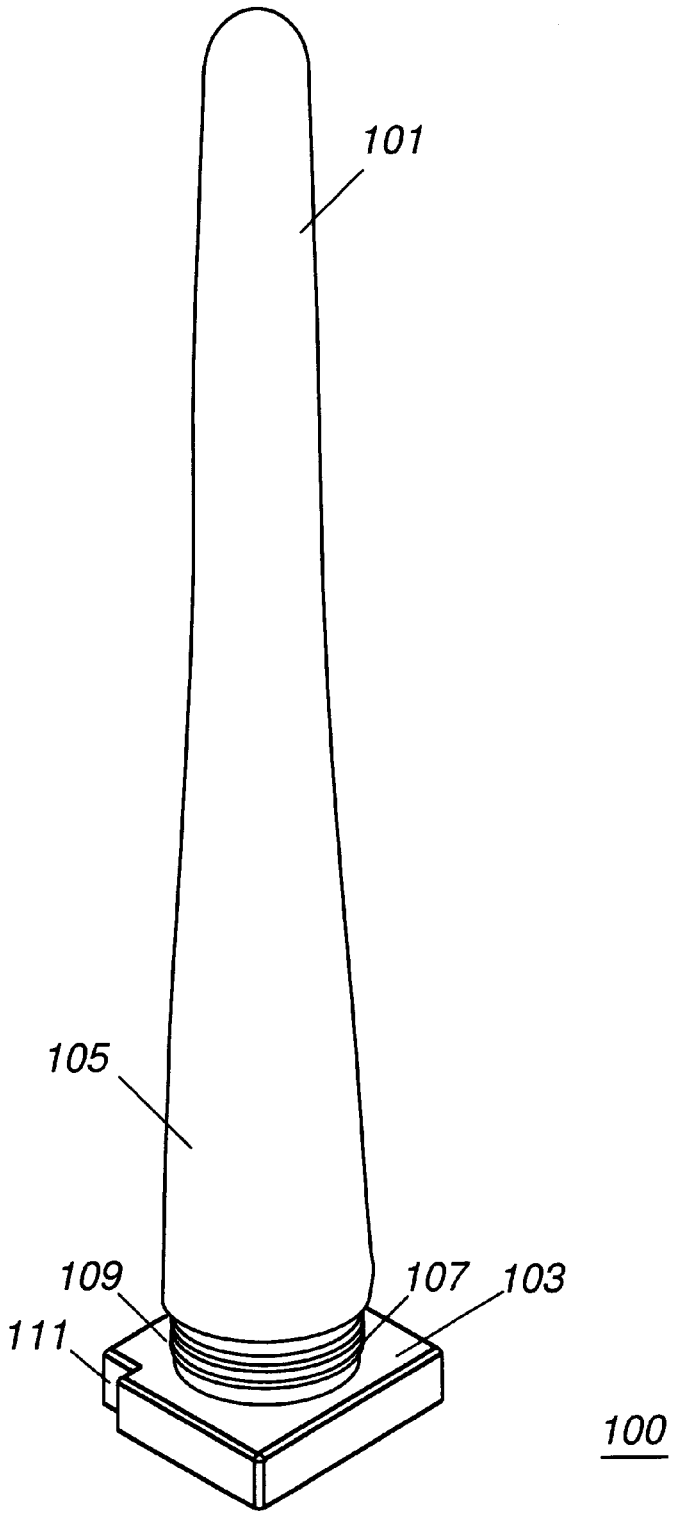
FIG. 2 is an isometric view of the antenna shroud in accordance with a preferred embodiment of the invention.

Referring now to FIGS. 1 and 2, a separable antenna shroud 100 for use with a portable communications device includes sheath 101 and a base 103. The sheath is manufactured of a pliable non-conductive material such as a soft plastic or rubber. The sheath 101 has a hollow interior and it is outside surface is tapered to form a substantially truncated conical shape. The sheath 101 is used to cover and/or protect a conductive radiating antenna element 121. As is well known in the art, the antenna element typically is electrically connected to one or more components on a circuit board and is used to radiate radio frequency energy at some designated frequency. The sheath 101 is separable and/or removable, that is it is possible to remove the sheath 101 for disassembly or servicing of the antenna element 121.

Near the lower portion of the antenna shroud 100, a smaller diameter cylindrical section 107 joins to the base 103. The cylindrical section 107 includes two or more rings 109 which are molded to the surface of the cylindrical section 107. The rings 109 are used to engage with aperture walls 113 located on the interior portion of an aperture 114 within the surface of a radio housing and provide a seal. Provided at the lower portion of antenna shroud 100 is a substantially rectangular base 103. An alignment notch 111, positioned in the base 103, is also used to orient the antenna with an alignment key 116 located in the radio housing during assembly.

Figure 3:
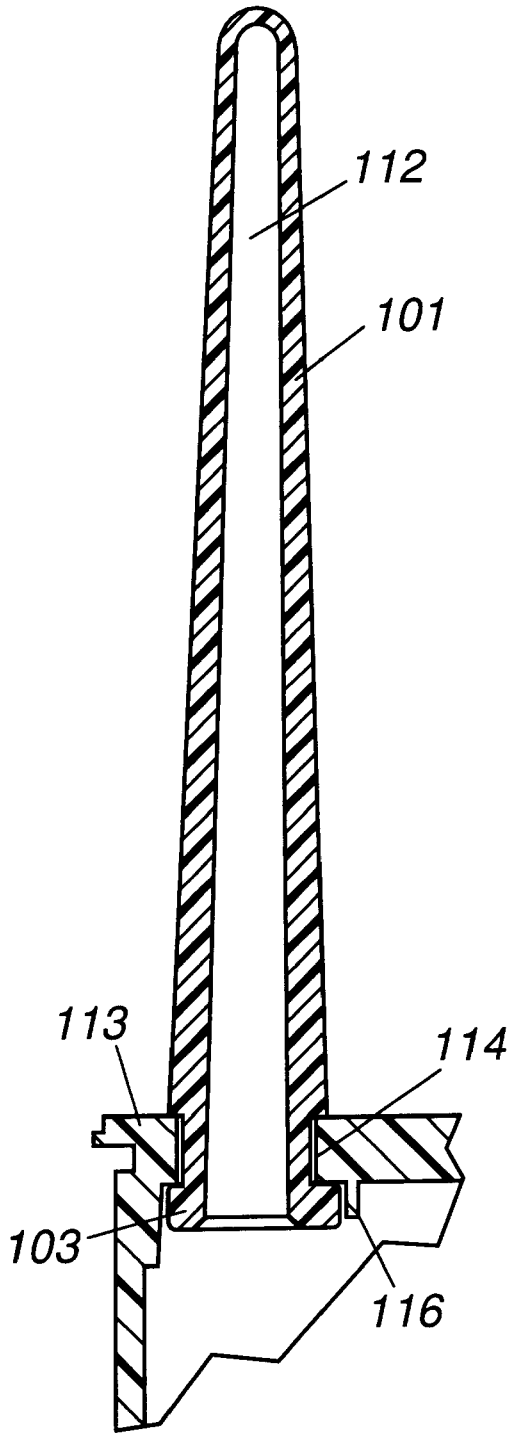
FIG. 3 is a cross-sectional side view of the antenna shroud shown in FIG. 2.
Figure 4:
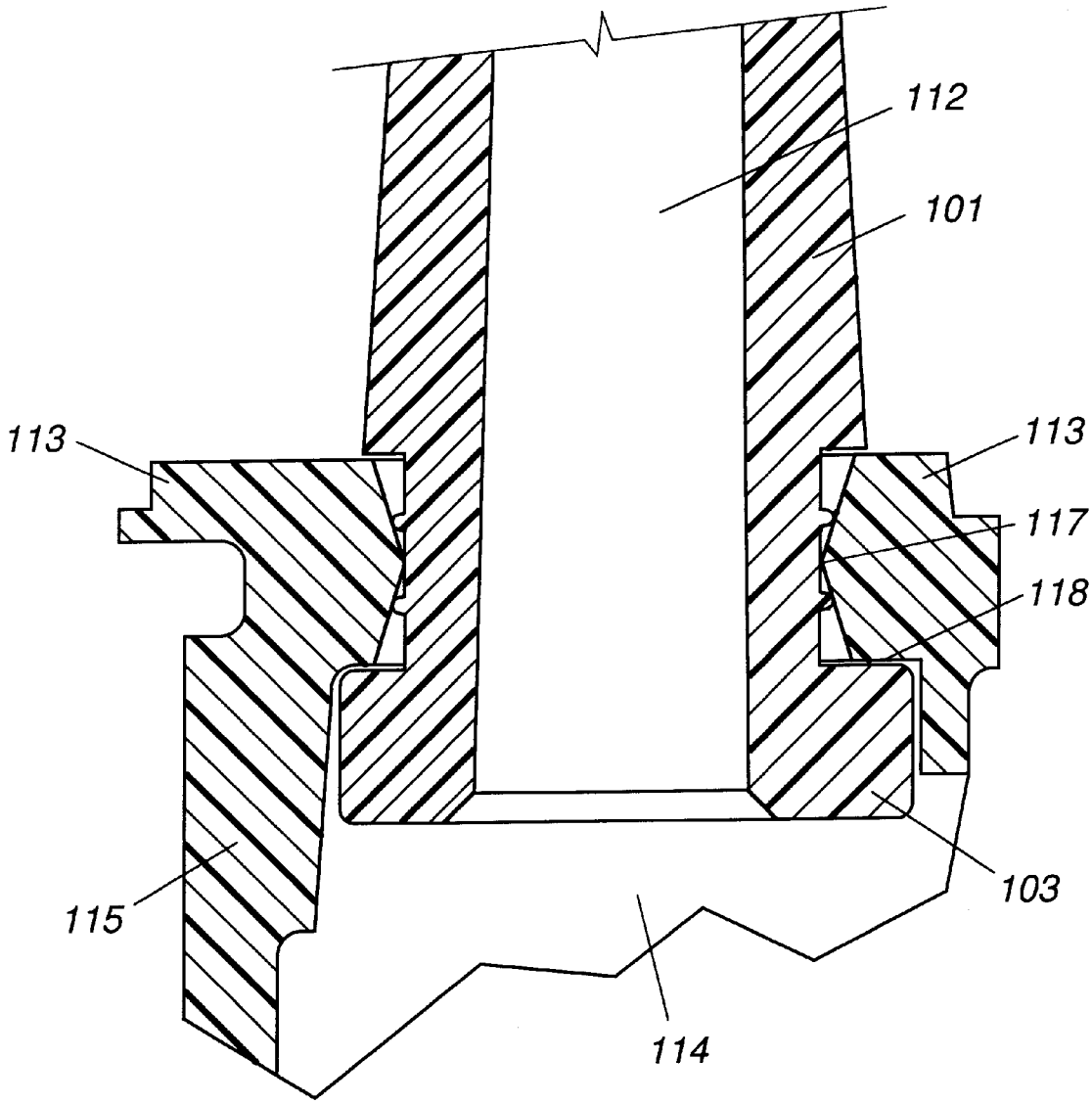
FIG. 4 is an enlarged cross-sectional side view of that of FIG. 3 showing engagement of the antenna shroud with a radio housing.

As seen in FIGS. 3 and 4, rings 109 provide a radial environmental seal on the inside of the aperture walls 113. The geometry of the aperture 114 is critical to the seal working effectively. As can been seen in FIG. 4, the diameter of the aperture wall 113 decreases to a minimum at a point 117 located substantially midway between the top or outside of the aperture wall 113 and the bottom or inside of the aperture wall 113. In the preferred embodiment, this is done by having the injection molding tool parting line located at that point 117. The aperture 114 is drafted in opposite directions on either side of the parting line. Alternatively, this can also be accomplished by machining the geometry into various materials if injection molding is not used to produce the enclosure.

Radial compression of one of the rings 109 increases when pulling or pushing on the shroud 100. Pulling the antenna shroud 100 outward causes the lower ring 109 to be under more compression while pushing inward will cause the upper ring 109 to be under more compression. If the shroud 100 is pulled perpendicular to its axis i.e. laterally, the rings 109 may no longer seal. In view of the soft durometer (approximately Shore 80A) of the material, additional sealing is provided by the rectangular base 103 on the bottom of the shroud 100. Thus in operation, the base 103 is pulled against the interior surface 118, adjacent to the aperture 114 to form a tight seal.

The antenna shroud 100 further includes a hollow section 112 and is inserted into the aperture 114 in a radio housing 115. The antenna shroud 100 is used to enclose an antenna element or radiator 121. The sheath 101 is separable from the radiator 121 for radio servicing. The sheath 101 is made of a pliable material and is inserted into the interior section of the aperture, to a point where it's large diameter at the bottom portion of the conically shaped sheath 101 is positioned through the aperture.

Additionally, the base 103 of the antenna shroud 100 abuts the interior surface 118, adjacent to the aperture 114 to prevent the sheath 101 from being pulled further through the aperture 114. The alignment notch 111 is used to engage with an locking member such as alignment key 116 located within the radio housing 115 to prevent it's rotation within the aperture 114. When in this position, the antenna shroud

100 is mechanically engaged within aperture 114 and is constrained. Thus, it cannot be rotated or moved longitudinally without application of a high amount of force.

In summary, the present invention is directed to an antenna shroud or cover which is used for covering a radiating antenna element used with a portable radio. The antenna shroud includes a hollow, pliable, nonconductive sheath attached to a base. The base is used for holding the sheath into a fixed position while the antenna shroud is located within an aperture cut into the housing used with the portable radio. The antenna shroud is used to seal the antenna opening in the radio housing and works also to protect the antenna element from damage. Additionally, the shroud also protects a user of the portable radio from coming into direct contact with radio frequency (RF) energy radiated by the antenna element.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna cover assembly having used with a radio housing for protecting a fixed antenna element comprising:

a removable shroud having a hollow interior section for fitting completely over the antenna element and a conical exterior section having a first diameter at the lower portion of the shroud;

a base attached to the lower portion of the shroud, the base having a second diameter including an alignment notch for engaging with an alignment key located on the radio housing; and wherein the shroud is inserted into an aperture located within the radio housing to a predetermined position where the alignment notch on the base engages with the alignment key on the radio housing for preventing both longitudinal and rotational movement of the antenna cover assembly within the radio housing relative to the antenna element.

2. An antenna cover assembly as in claim 1 wherein the shroud and base are made of a pliable material.

* * * * *